US011015357B2

(12) United States Patent
Walsh et al.

(10) Patent No.: US 11,015,357 B2
(45) Date of Patent: May 25, 2021

(54) CONSTRUCTION ANCHOR APPARATUS

(71) Applicant: Anchor Ring Solutions, LLC, Pen Argyl, PA (US)

(72) Inventors: James R. Walsh, Westport, CT (US); Charles Mayer, Effort, PA (US); Joseph A. Fugallo, III, East Meadow, NY (US); Joseph Fugallo, IV, East Meadow, NY (US); Michael J. Tomack, Monroe, NJ (US); John P Marra, Bangor, PA (US)

(73) Assignee: Anchor Ring Solutions, LLC, Pen Argyl, PA (US)

( * ) Notice: Subject to any disclaimer, the term of this patent is extended or adjusted under 35 U.S.C. 154(b) by 0 days.

(21) Appl. No.: 16/596,988

(22) Filed: Oct. 9, 2019

(65) Prior Publication Data

US 2021/0108429 A1 Apr. 15, 2021

(51) Int. Cl.
*E04G 21/32* (2006.01)

(52) U.S. Cl.
CPC ..... *E04G 21/3223* (2013.01)

(58) Field of Classification Search
CPC ..... E04G 21/3223; E04G 21/3276; E04B 1/4142; E04B 2001/4192; E04C 5/162
USPC ..... 52/125.4, 124.2, 125.5, 702, 704, 707, 52/710
See application file for complete search history.

(56) References Cited

U.S. PATENT DOCUMENTS 1,700,889 A * 2/1929 Heltzel ..... E01C 23/021 249/4
2,031,901 A * 2/1936 Mitchell ..... E01C 23/045 404/88
2,079,123 A * 5/1937 Lind ..... E01C 11/14 404/62
2,095,060 A * 10/1937 Geyer ..... E01C 11/14 404/60
2,265,301 A 12/1941 Meyer et al.
2,269,703 A * 1/1942 Bagwill ..... E01C 11/14 404/60
2,277,449 A * 3/1942 Paine ..... E04B 1/415 52/706

(Continued)

FOREIGN PATENT DOCUMENTS

EP 2743426 A1 6/2014

OTHER PUBLICATIONS

International Search Report dated Nov. 21, 2017 issued in corresponding PCT Application No. PCT/US2017/049086.

*Primary Examiner* — Joshua K Ihezie

(74) *Attorney, Agent, or Firm* — Ryan, Mason & Lewis, LLP

(57) ABSTRACT

A construction anchor apparatus includes a main module having first and second wall segments and defining a central longitudinal axis, a first movable support operatively coupled to the first wall segment of the main module and having a first tube segment defining an opening therethrough and a second movable support operatively coupled to the second wall segment of the main module and defining an opening configured for reception of the first tube segment of the first movable support to couple the first and second movable supports. Each of the first and second movable supports configured for longitudinal movement relative to respective first and second wall segments of the main module.

20 Claims, 8 Drawing Sheets

(56) References Cited

U.S. PATENT DOCUMENTS 2,636,426 A * 4/1953 Heltzel ..... E01C 19/504 249/9
3,550,343 A * 12/1970 Buske ..... E04B 1/4142 52/704
3,599,379 A 8/1971 Tuska
3,705,469 A 12/1972 Eriksson
4,000,591 A 1/1977 Courtois
4,437,642 A 3/1984 Holt
4,580,378 A 4/1986 Kelly et al.
4,648,739 A * 3/1987 Thomsen ..... E01C 11/227 404/2
4,945,704 A 8/1990 Brown, Jr.
5,226,265 A 7/1993 Kelly et al.
5,487,249 A * 1/1996 Shaw ..... E01C 11/14 404/60
5,623,804 A 4/1997 Kelly et al.
5,625,993 A 5/1997 Kelly
6,092,849 A 7/2000 Zambelli et al.
6,550,834 B2 * 4/2003 Fromelius ..... B66C 1/666 294/89
6,598,364 B1 7/2003 Pelles
6,688,049 B2 2/2004 Sanftleben et al.
7,137,609 B2 11/2006 Sack
7,547,158 B1 * 6/2009 Mucci ..... E01C 11/08 404/47
8,024,896 B2 9/2011 Azarin
8,413,400 B2 4/2013 Mackay Sim
8,806,836 B2 8/2014 James et al.
8,966,833 B2 * 3/2015 Ally ..... E04B 1/35 52/125.4
9,127,415 B1 9/2015 Blackwell
9,353,535 B2 * 5/2016 Borchardt ..... E04B 1/415
9,359,779 B2 * 6/2016 Borchardt ..... E04G 21/3295
2002/0062604 A1 5/2002 Fromelius
2004/0040251 A1 * 3/2004 Mok ..... E04G 21/185 52/719
2004/0136785 A1 7/2004 Gunter
2007/0039281 A1 2/2007 Zambelli et al.
2010/0000175 A1 1/2010 Johnson et al.
2011/0108319 A1 5/2011 Gauthier
2011/0265296 A1 11/2011 Perkins
2014/0069048 A1 * 3/2014 Ally ..... E04B 1/41 52/699
2015/0196782 A1 7/2015 Akagane
2015/0196785 A1 7/2015 Borchardt
2015/0367152 A1 * 12/2015 Borchardt ..... E04G 21/185 248/324
2016/0096047 A1 4/2016 Sailer
2016/0168849 A1 6/2016 Ryan
2018/0058062 A1 * 3/2018 Mayer ..... E04B 1/4142

* cited by examiner

CONSTRUCTION ANCHOR APPARATUS

BACKGROUND

1. Technical Field

The present disclosure relates to a construction apparatus, and, in particular, relates to an anchor apparatus adapted to function as a safety grip for construction personnel and/or for supporting construction equipment such as ductwork, electrical cables, plumbing etc. within a construction-site.

2. Background of Related Art

Construction sites require grip or strap devices to ensure the safety of construction personnel operating at the site. A conventional grip device may include a strap which is secured to a wall, beam or the like through a fastener and placed at various locations within the construction site such that upon moving through the site, the construction personnel may engage one of the devices at one or more select locations.

However, conventional grip devices present a number of obstacles, which detract from their overall usefulness. First, application of the grip device requires additional tasks to secure the device to the structural element. Secondly, the integrity of the grip device is dependent on the fastener utilized and its application, which, in many instances, is insufficient to adequately support construction personnel. Furthermore, current grip devices only have a single utility as a safety grip and cannot be used in conjunction with other tasks to be performed at the construction site.

One anchor apparatus which addresses many of these issues of conventional grip devices is disclosed in commonly assigned U.S. Patent Publication No. 20180058062 to Mayer et., the entire contents of which are incorporated by reference herein.

SUMMARY

Accordingly, the present invention is directed to a construction anchor apparatus having utility as a safety grip for engagement by construction personnel, and, in addition, a support apparatus for supporting and/or holding construction equipment including ductwork, electrical cables, plumbing etc. The anchor apparatus is used in conjunction with a reinforcement member such as, e.g., rebar, applied in concrete support walls, floors, ceilings or other structural elements at a construction site.

In one embodiment, a construction anchor apparatus includes a main module having first and second wall segments and defining a central longitudinal axis, a first movable support operatively coupled to the first wall segment of the main module and having a first tube segment defining an opening therethrough and a second movable support operatively coupled to the second wall segment of the main module. The second movable support defines an opening configured for reception of the first tube segment of the first movable support to couple the first and second movable supports. The openings of the first and second movable supports are dimensioned for reception and passage of a reinforcement member, e.g., rebar. Each of the first and second movable supports is adapted for longitudinal movement relative to respective first and second wall segments of the main module to permit corresponding movement of the rebar within the main module.

The second movable support may include a second tube segment, which defines the opening for reception of the first tube segment of the first movable support. The first and second movable supports may be configured for movement in first and second longitudinal directions with respect to the longitudinal axis. At least one of the first and second movable supports is biased in a first longitudinal direction with respect to the longitudinal axis. A resilient member may be mounted within the main module, and is operatively engageable with the at least one of the first or second movable supports. In an embodiment, the resilient member is a spring positioned to engage the first tube segment of the first movable support.

An end cap may be mountable to the main module, and supports the spring. The end cap may include spring supports which are correspondingly dimensioned to at least partially accommodate the spring member to facilitate alignment with the first tube segment of the first movable support.

In embodiments, the first and second wall segments of the main module include respective first and second module mounts. The first movable support is coupled to the first module mount and is configured for reciprocal longitudinal movement relative to the first module mount, and the second movable support is coupled to the second module mount and is configured for reciprocal longitudinal movement relative to the second module mount. The first and second module mounts each define elongated openings in alignment with the openings of the first and second movable supports to permit traversing longitudinal movement of the reinforcement member.

The openings of the first and second movable supports are each configured to permit passage of a reinforcement member therethrough. At least one of the first or second module mounts includes a guide depending outwardly therefrom with respect to the central longitudinal axis. The guide is configured to facilitate alignment of the reinforcement member with the opening of the respective first or second movable support. In embodiments, each of the first and second module mounts includes a guide depending outwardly therefrom. The guides also may function as stops or limits positioned to engage the rebar to contain movement of the rebar within the main module.

In another exemplary embodiment, a construction anchor apparatus includes a main module having first and second wall segments and defining a central longitudinal axis, with the first and second wall segments each defining respective first and second elongated openings, a first movable support operatively coupled to the first wall segment of the main module and having a first tube segment defining an opening therethrough for reception of a reinforcement member, a second movable support operatively coupled to the second wall segment of the main module and defining an opening configured for reception of the first tube segment of the first movable support to couple the first and second movable supports. The openings of the first and second movable supports are configured for reception of the reinforcement member. Each of the first and second movable supports are configured for longitudinal movement relative to respective first and second wall segments of the main module to permit longitudinal traversing movement of the reinforcement member within the main module while the reinforcement member traverses the elongated openings of the first and second wall segments. A spring member is operatively couplable to one of the first and second movable supports to bias the first and second movable supports in a first longitudinal direction.

In another exemplary embodiment, a method includes positioning an anchor apparatus at a predetermined location within a construction site, securing a main module of the anchor apparatus at the predetermined location, coupling first and second movable supports to the main module and to each other with each of the first and second movable supports having openings therethrough, passing a reinforcement member through the openings in the first and second movable supports and through the main module and permitting the first and second movable supports to move in a longitudinal direction to permit corresponding movement of the reinforcement member relative to the main module. A support assembly may be secured to the reinforcement member.

Other advantages of the construction anchor apparatus will be appreciated from the following description.

BRIEF DESCRIPTION OF THE DRAWINGS

Various aspects and features of the present disclosure are described hereinbelow with references to the drawings, wherein.

DETAILED DESCRIPTION

Particular embodiments of the present disclosure are described hereinbelow with reference to the accompanying drawings. However, it is to be understood that the disclosed embodiments are merely examples of the disclosure and may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to employ the present disclosure in virtually any appropriately detailed structure.

Figure 1:
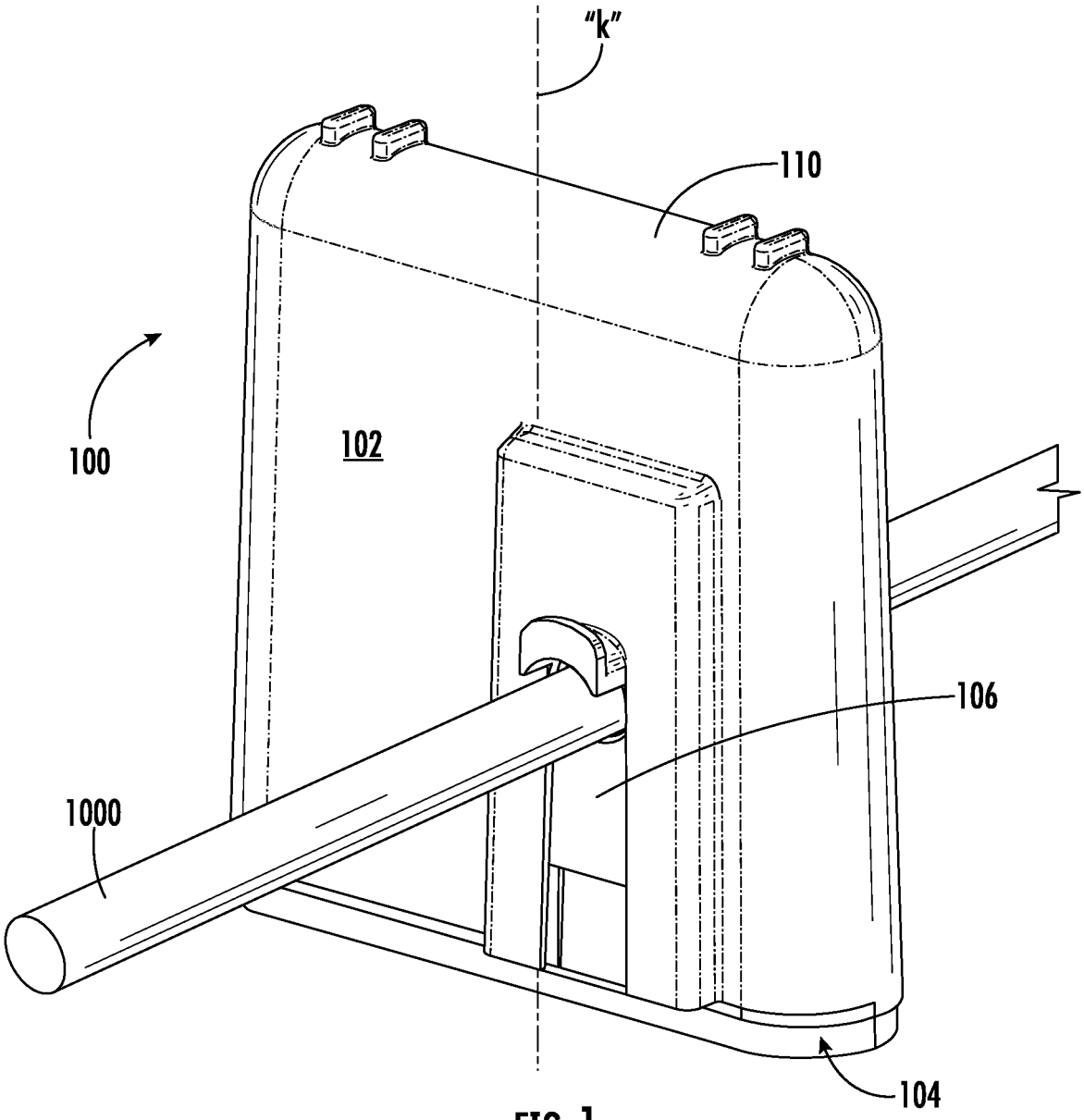
FIG. 1 is a perspective view of the construction anchor apparatus in accordance with the principles of the present disclosure illustrating the main module, the end cap mounted to the main module and first and second movable supports coupled to the main module, and further illustrating a reinforcement member received within the first and second movable support and extending through the main module, in accordance with the principles of the present disclosure.

Referring now to FIG. 1, there is illustrated the construction anchor apparatus 100 in accordance with the principles of the present disclosure. In FIG. 1, the anchor apparatus 100 is depicted supporting a length of reinforcement bar (e.g., rebar) 1000 which may be engaged by a support assembly for safety purposes for construction personnel and/or for supporting and/or holding construction equipment such as ductwork, electrical cables, plumbing materials or the like.

Figure 4:
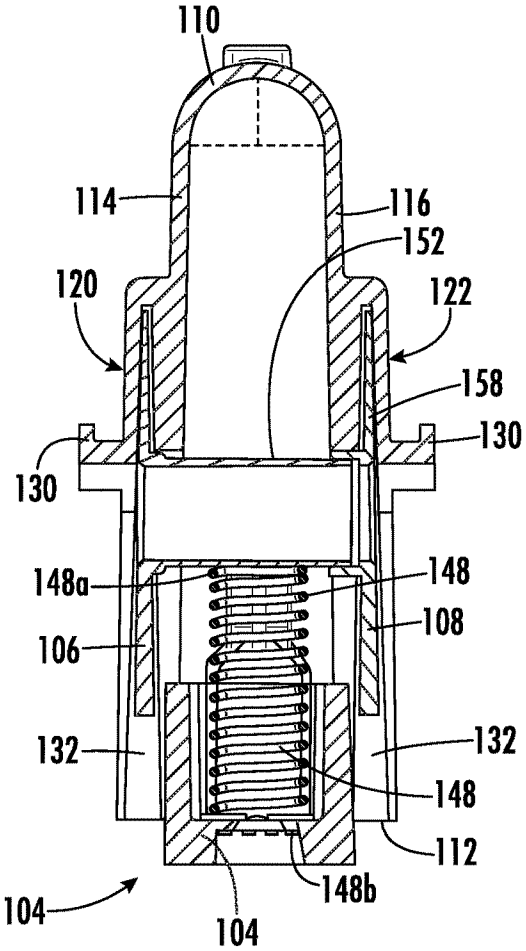
FIG. 4 is a cross-sectional view taken along the lines 4-4 of FIG. 2 of the anchor apparatus.
Figure 3:
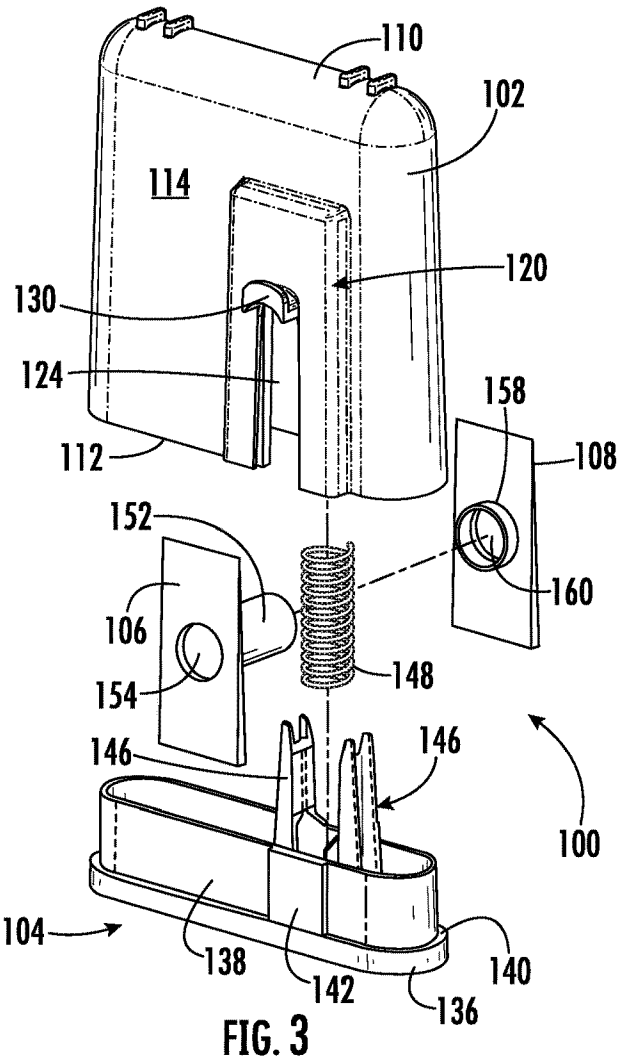
FIG. 3 is an exploded perspective view of the anchor apparatus.
Figure 2:
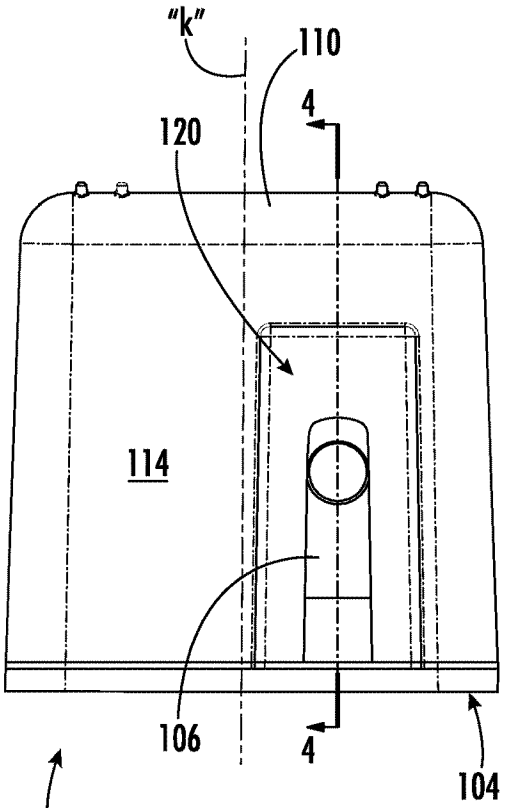
FIG. 2 is a side elevation view of the anchor apparatus of FIG. 1.
Figure 7:
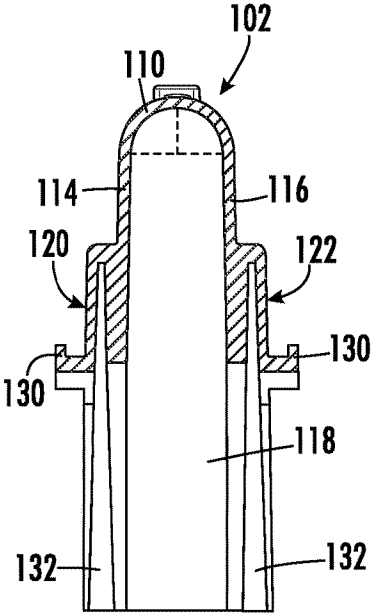
FIG. 7 is a cross-sectional view of the main module of the anchor apparatus taken along the lines 7-7 of FIG. 5.
Figure 5:
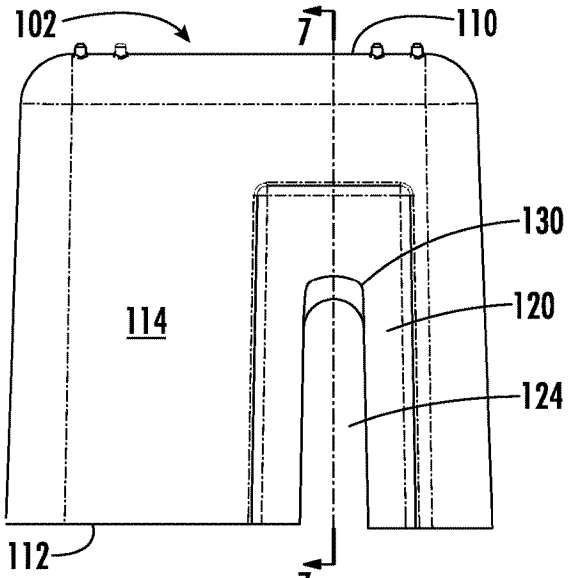
FIG. 5 is a side elevation view of the main module of the anchor apparatus.
Figure 6:
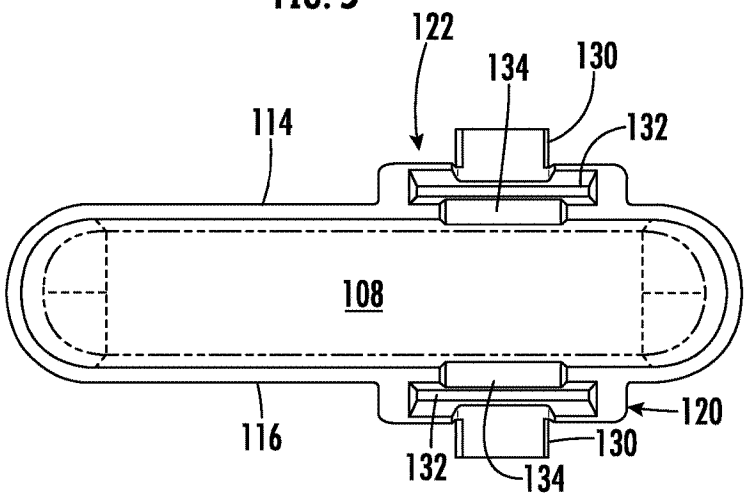
FIG. 6 is a bottom plan view of the main module of the anchor apparatus.

With reference now to FIGS. 2-4, in conjunction with FIG. 1, the anchor apparatus 100 includes a main module 102 defining a central longitudinal axis "k", an end cap 104 mountable to the main module 102 and first and second movable supports 106, 108. As best depicted in FIGS. 5-7, the main module 102 may be generally rectangular or square-shaped to define a box having a closed end 110, an open end 112 adjacent the end cap 104 and opposed first and second wall segments 114, 116 to which the movable supports 106, 108 are respectively coupled. The main module 102 defines an internal chamber 118 through which the rebar 1000 passes. The internal chamber 118 also may receive concrete at the end of the construction phase of the project. In embodiments, the dimensioning of the main module 102 corresponds to the mold work utilized to eventually form the support column, support wall, ceiling, floor or other construction element to be constructed within the site. For example, the height and depth of the main module 102 may correspond to the depth of the mold work used in forming a column of a support wall, ceiling or floor in which the module 102 will be positioned. Although shown as generally rectangular, the main module 102 may assume other shapes such as circular or other polygonal configurations.

With reference to FIGS. 3-6, the main module 102 includes, or defines, a pair of module mounts 120, 122 respectively disposed on the first and second wall segments 114, 116. The module mounts 120, 122 receive the movable supports 106, 108, respectively, in a manner to permit reciprocal longitudinal movement, e.g., sliding movement, of the movable supports 106, 108. Each module mount 120, 122 includes an elongated opening 124 which is in communication with the internal chamber 118 of the main module.

The elongated openings 124 are dimensioned to permit passage of the reinforcement member 1000 while also permitting relative traversing longitudinal movement of the reinforcement bar 1000 relative to the central longitudinal axis "k". The elongated openings 128 may be coterminous with the open end 112 of the main module 102 or may extend short of the open end 112. The elongated openings 128 are offset with respect to the central longitudinal axis "k".

At least one of the first or second module mounts 120, 122, e.g., both, may include a guide 130 depending outwardly with respect to the central longitudinal axis "k" adjacent the upper end of each elongated opening 124. In embodiments, the guide 130 may be configured to facilitate alignment of the reinforcement member 1000 for positioning within the main module 102. The guide 130 may also function as a stop restraining travel of the reinforcement member 1000 within the first and second module mounts 120, 122, i.e., beyond the guides 130.

As best depicted in FIGS. 6-7, the module mounts 120, 122 each define opposed internal grooves 132 on each side of the elongated opening 124. The internal grooves 132 have an internal dimension orthogonal to the central longitudinal axis, which decreases adjacent the open end 112 of the main module 102 toward the closed end 110 of the main module 102. The internal grooves 132 receive the edges of the movable supports 106, 108 to couple the movable supports 106, 108 to the module mounts 120, 122. The module mounts 120, 122 may further define recesses 134 adjacent the internal chamber 118 of the main module 102. (FIG. 6). The recesses 134 facilitate alignment and mounting of the end cap 104 to the main module 102.

Figure 8:
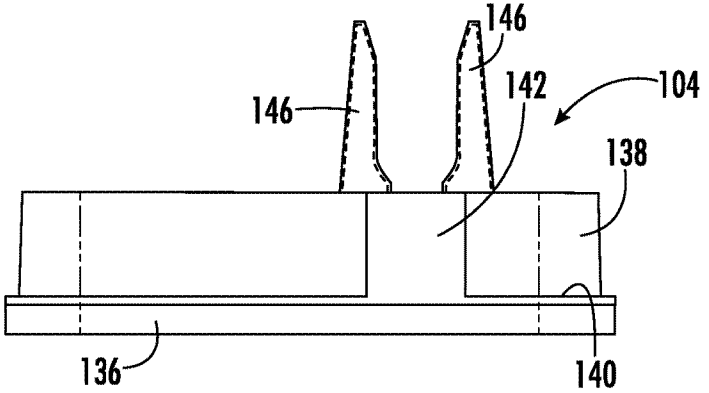
FIG. 8 is a side plan view of the end cap of the anchor apparatus.
Figure 9:
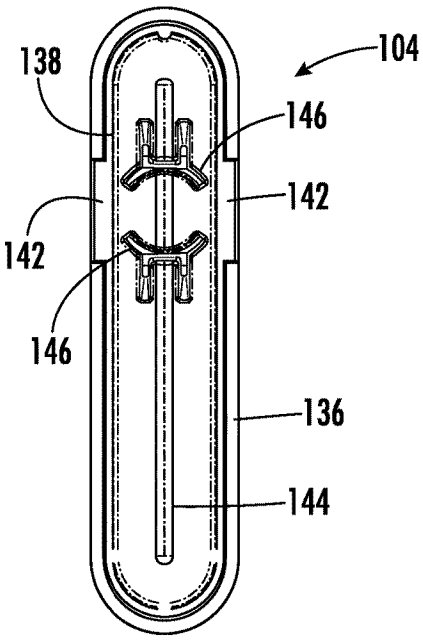
FIG. 9 is a bottom plan view of the end cap of the anchor apparatus.

With reference to FIGS. 8-9, in conjunction with FIGS. 3-4, the end cap 104 is configured for mounting to the open end 112 of the main module 102. In an embodiment, the end cap 104 includes an end face 136 and an outer cap wall 138 depending from the end face 136. The outer cap wall 138 is dimensioned to be received within the open end 112 of the main module 102 and, e.g., establish a frictional relation therewith. The intersection of the end face 136 and the outer cap wall 138 defines a ledge 140 which engages the outer boundary of the main module 102. The end face 136 may include a pair of opposed rails 142 which are received within the correspondingly dimensioned recesses 134 (FIG. 6) of the module mounts 120, 122 to facilitate proper alignment of the end cap 104 relative to the main module 102. The outer surface of the end face 136 of the end cap 104 may include a slot, groove or recess 144 (shown in phantom in FIG. 9) to facilitate its removal during operation of the anchor apparatus 100.

With continued reference to FIGS. 3, 4, 8 and 9, the interior of the end cap 104 includes a pair of spring guides 146 depending from the end face 136 of the end cap 104. The spring guides 146 are spaced and are arcuate in dimension. The spring guides 146 receive or support a resilient member or spring 148 positioned within the main module 102—the functioning of which will be discussed hereinbelow.

Referring now to FIGS. 10A-11B, the first and second movable supports 106, 108 will be discussed. The first and second movable supports 106, 108 are rectangular in shape to generally correspond to the configuration of their respective module mounts 120, 122. The first movable support 106 includes a first plate segment 150 and a first tubular segment 152 depending from the first plate segment 150. The first tubular segment 152 defines an opening 154 for reception and passage of the reinforcement member 1000. The second movable support 108 includes a second plate segment 156 and a second tubular segment 158 depending from the second plate segment 156. The second tubular segment 158 defines an opening 160 having an internal dimension or diameter which is greater than the outer diameter of the first tubular segment 152 of the first movable support 106 to receive the first tubular segment 152 of the first movable support 106. With this arrangement, the first and second movable supports 106, 108 are coupled to each other whereby the first and second movable supports 106, 108 move concurrently along the central longitudinal axis "k". In addition, the coupling of the first and second movable supports 106, 108 ensures the openings 154, 160 of the first and second tubular segments 152, 158 are aligned to collectively receive the reinforcement member 1000. The first tubular segment 152 of the first movable support 106 bottoms out or engages an internal annular ledge 162 (FIGS. 11A-11B) within the second movable support 108.

In the alternative, the second movable support 108 may be devoid of the second tubular segment 158 and define an opening dimensioned to receive the first tubular segment 152 of the first movable support 106. In this embodiment, the first tubular segment 152 may be greater in length to be received within the second opening 160 of the second movable support 108.

The first and second plate segments 150, 156 of the first and second movable supports 106, 108 each define a thickness which gradually tapers or decreases from the end adjacent the end cap 104 to the top end 110 of the main module 102. The thicknesses of the first and second plate segments 150, 156 generally correspond to the depths of the internal grooves 132 of the module mounts 120, 122 (FIG. 7) to permit the first and second plate segments 150, 156 to slide within the first and second module mounts 120, 122, e.g., within the respective grooves 132 thereof.

With reference again to FIGS. 3-4, the spring 148 is positioned within the spring guides 146 depending from the end face 136 of the end cap 104 and engages either or both the first or second tubular segments 152, 158 of the first and second movable supports 106, 108. In embodiments, one end **148*a* of the spring 148 spring engages the first tubular segment 152 of the first movable support 106 to bias the first movable support 106 and thus, the second movable support 108 (which is coupled to the first movable support 106) in an upward direction. At its other end 148*b*, the spring 148 engages the end cap 104. The spring 148 will maintain the first and second movable supports 106, 108 in the initial position depicted in FIGS. 2 and 4. This may assist the operator in passing the reinforcement member 1000 through the respective openings 154, 160 of the first and second tubular segments 152, 158 in that the spring 148 will resist initial movement of the first and second movable supports 106, 108 as the reinforcement member 1000 is being aligned with the main module 102**.

In FIG. 4, the first and second movable supports 106, 108 are in an initial condition under the influence of the spring 148 with the openings 154, 160 of the first and second movable members 106, 108 adjacent the guides 130 of the first and second module mounts 120, 122. The first and second movable members 106, 108 are capable of longitudinal movement against the bias of the spring 148 within the first and second module mounts 120, 122 to permit traversing movement of the reinforcement member 1000 within the main module 102.

Figure 12A:
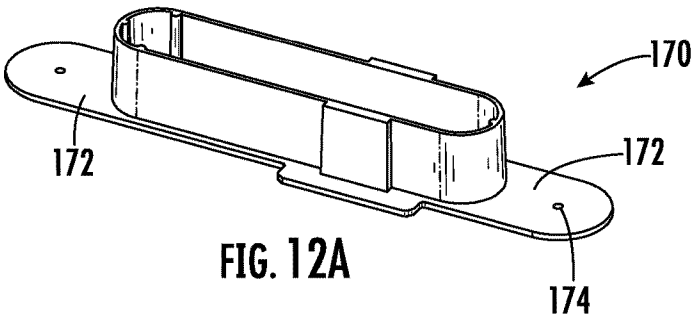
FIGS. 12A-12B are perspective and top plan views, respectively, of an alternate end cap of the anchor apparatus.
Figure 12B:
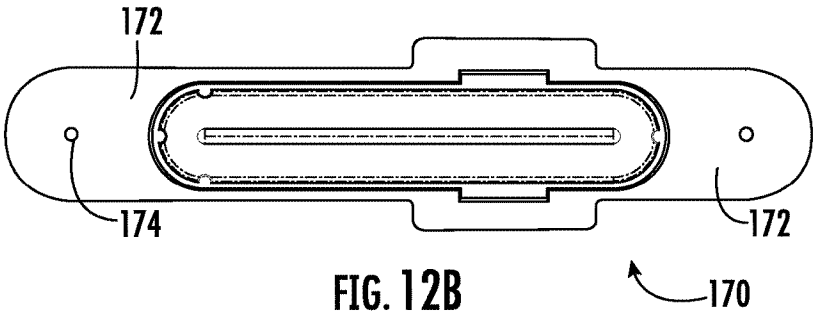
Figure 10B:
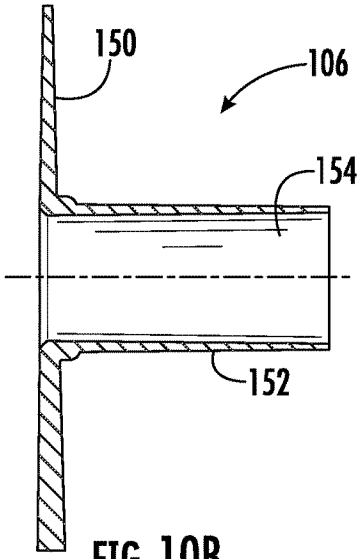
FIGS. 10A-10B are perspective and cross-sectional views, respectively, of the first movable support of the anchor apparatus.
Figure 11B:
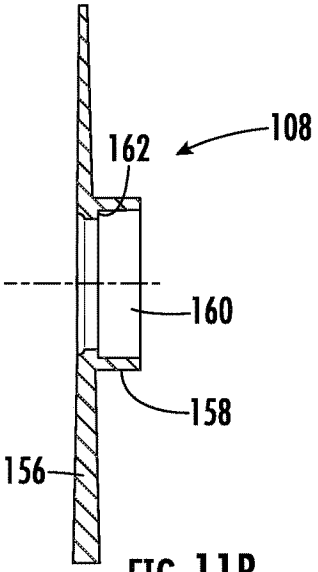
FIGS. 11A-11B are perspective and cross-sectional views, respectively, of the second movable support of the anchor apparatus.
Figure 10A:
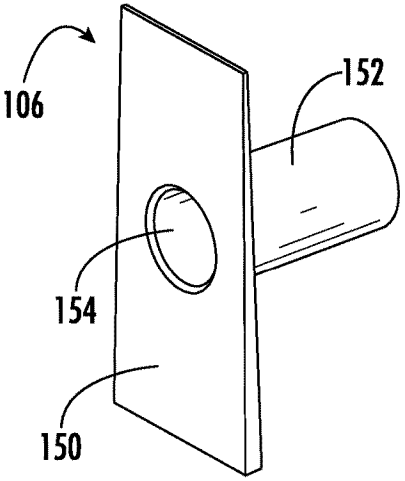
Figure 11A:
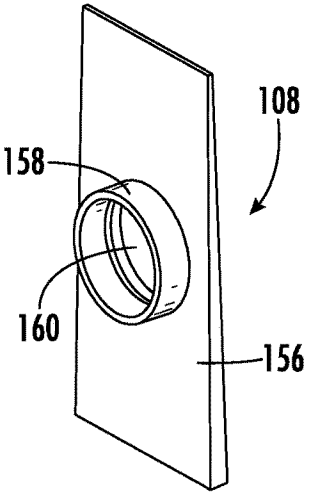

FIGS. 12A-12B illustrate an alternate end cap 170 for use with the anchor apparatus 100. This end cap 170 is substantially similar to the end cap 104 of FIGS. 8-9, but further includes a pair of opposed outer flanges 172. The flanges may be dimensioned to span the predetermined space within framing such that the end cap 170, and thus the anchor apparatus 100 may be secured to the framing. The flanges 172 may include apertures 174 to receive the fasteners utilized in securing the end cap 170. This end cap is devoid of spring supports for supporting the spring 148.

Figure 14:
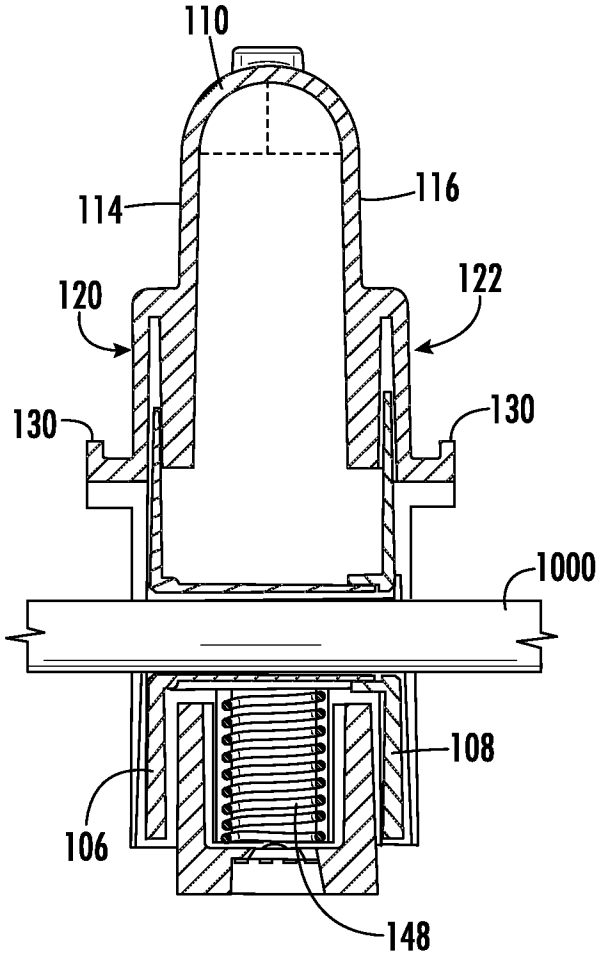
FIG. 14 is a cross-sectional view similar to the view of FIG. 4 illustrating the first and second movable supports in the displaced position.
Figure 13:
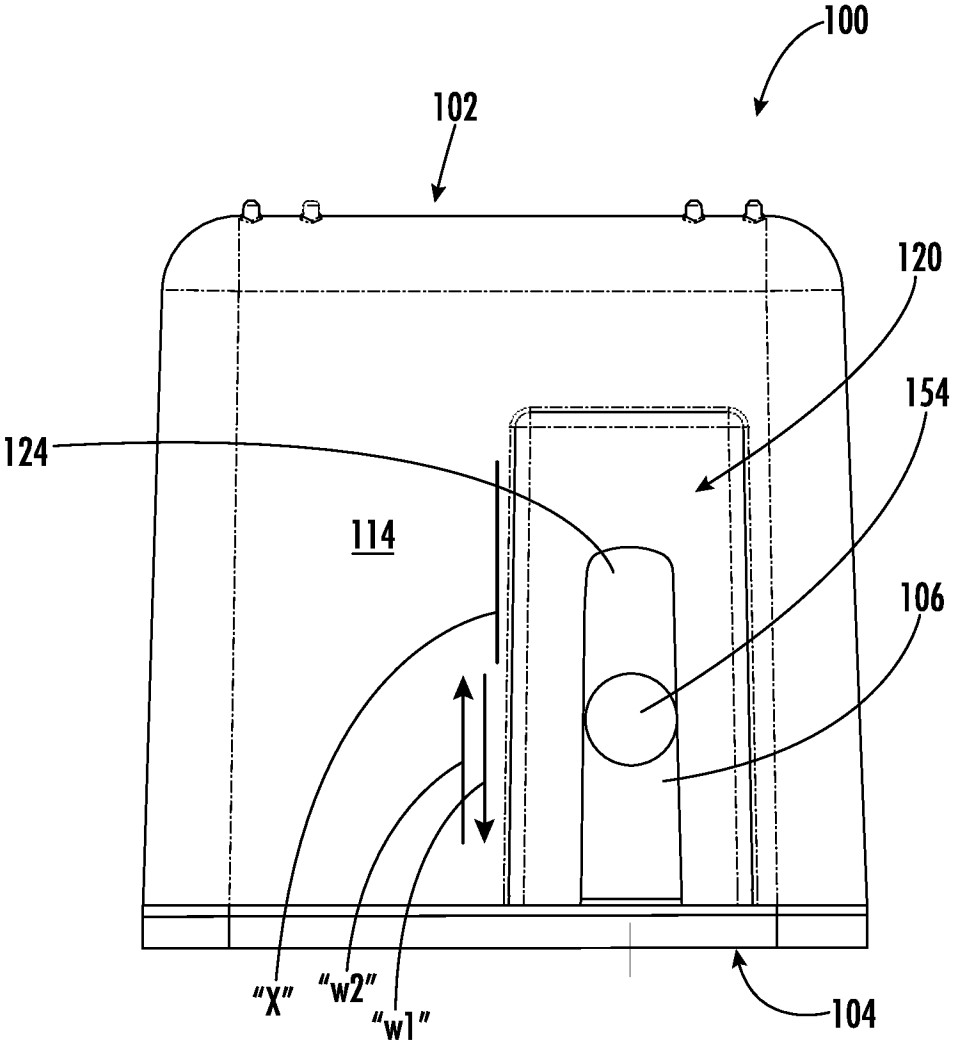
FIG. 13 is a side elevation view similar to the view of FIG. 2 illustrating the first and second movable supports in a displaced position.

Referring now to FIGS. 13-14, the first and second movable supports 106, 108 may traverse or reciprocally move within their respective module mounts 120, 122 in the direction of directional arrows "w1", "w2" (e.g., along the central longitudinal axis "k") to permit movement of the reinforcement member 1000 subsequent to, or after, mounting of the anchor apparatus 100 to the structural element. Specifically, the first and second movable supports 106, 108 may move from the initial position of FIGS. 2 and 4 to the fully displaced position of FIGS. 13-14, and positions in between, against the bias of spring 148 to receive the reinforcement member 1000. In the fully displaced position, the first and second movable supports 106, 108 may engage the end cap 104. FIG. 14 illustrates the reinforcement member 1000 extending through the openings 154, 160 of the first and second movable supports 106, 108 and sliding through the elongated openings 124 of the first and second module mounts 120, 122.

The use of the anchor apparatus 100 at a construction site will now be described. A plurality of anchor apparatuses 100 are positioned at various predetermined locations within the construction site to eventually serve as safety grips for construction personnel or supports for construction equipment. In embodiments, these locations are coincident with walls, ceilings, floors, columns or other structural elements. Each anchor apparatus 100 may be temporarily secured at the select position with tie rods or the like. In the alternative, with the end cap 170 of FIGS. 12A-12B, the anchor apparatus 10 may be temporarily secured by driving fasteners through the apertures 174 of the flanges 172. Thereafter, a reinforcement member 1000, e.g., rebar, is passed through the main module 102 by introducing the rebar 1000 through the openings 154, 160 of the movable supports 106, 108. As noted hereinabove, through the coupling arrangement of the first and second tubular segments 152, 158 of the first and second movable supports 106, 108, the openings 154, 160 are in alignment with themselves to facilitate passage of the reinforcement member 1000. In addition, the first and second movable supports 106, 108 are each in their rest position under the influence of the spring 148 whereby the openings 154, 160 are adjacent the guides 130. Thus, the operator can utilize the guides 130 to introduce the reinforcement member 1000 within the openings 154, 160 of the first and second movable supports 106, 108. Additionally, or alternatively, the first and second movable supports 106, 108 may move in either longitudinal direction within the respective first and second module mounts 120, 122 to align with the reinforcement member 1000 to permit reception and passage of the reinforcement member through the openings 154, 160 of the first and second movable supports 106, 108 and through the main module 102.

Figure 15:
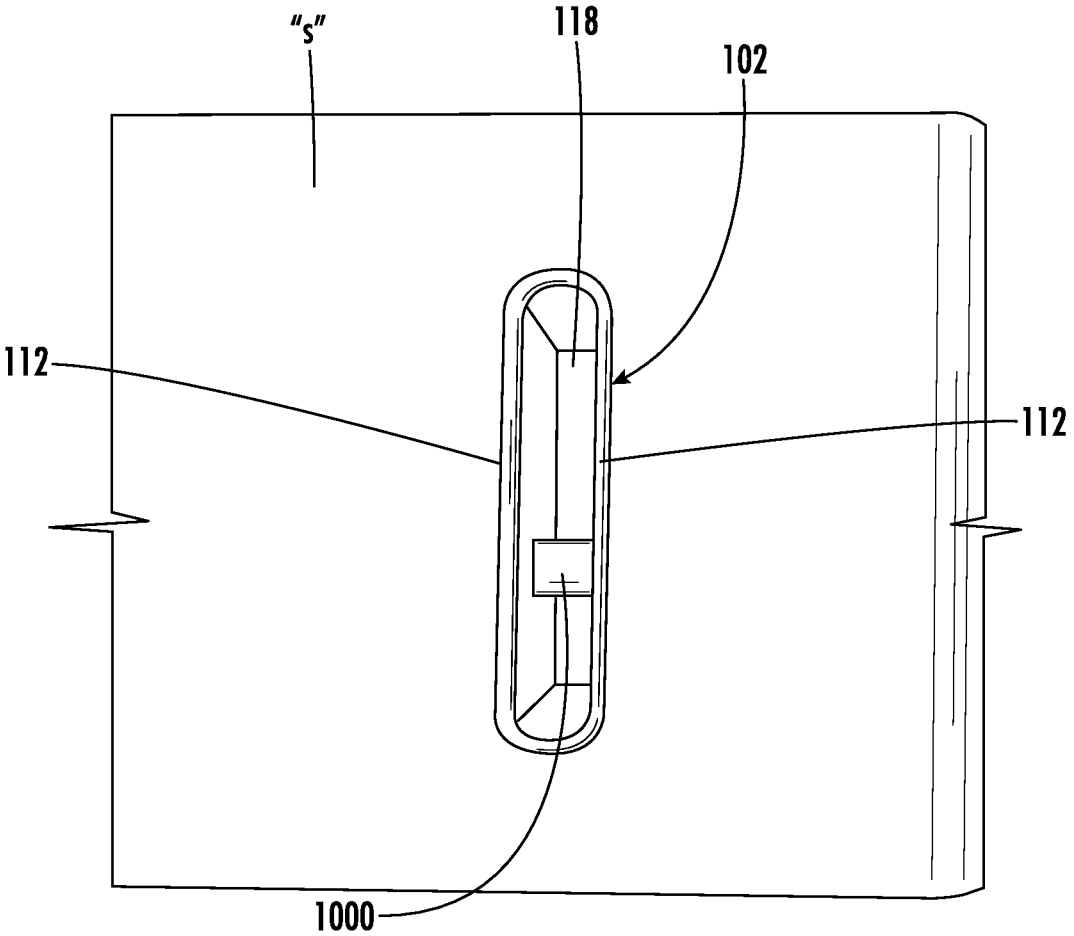
FIG. 15 is a view illustrating the anchor apparatus mounted to a structural element with a reinforcement member coupled to the anchor apparatus.

Thereafter, with reference to FIG. 15, concrete may be poured to form the structural element "s", i.e., the column, floor, wall etc. with the anchor apparatus 100 mounted therewithin. The concrete cures and the anchor apparatus 100 is secured relative to the structural element "s" The end cap 104 may be removed as shown through, e.g., engagement of a removal tool, e.g., a flat head screwdriver, with the recess 144 of the end cap 104 to expose the rebar 1000 within the internal chamber 118 of the main module 102. In the embodiment of the end cap 170 of FIGS. 12 A-12B, the flanges 172 may be pried from the framing to remove the end cap 170 to expose the internal chamber 118 of the main module 102 and/or the fasteners may be removed followed by removal of the end cap 170.

Figure 17:
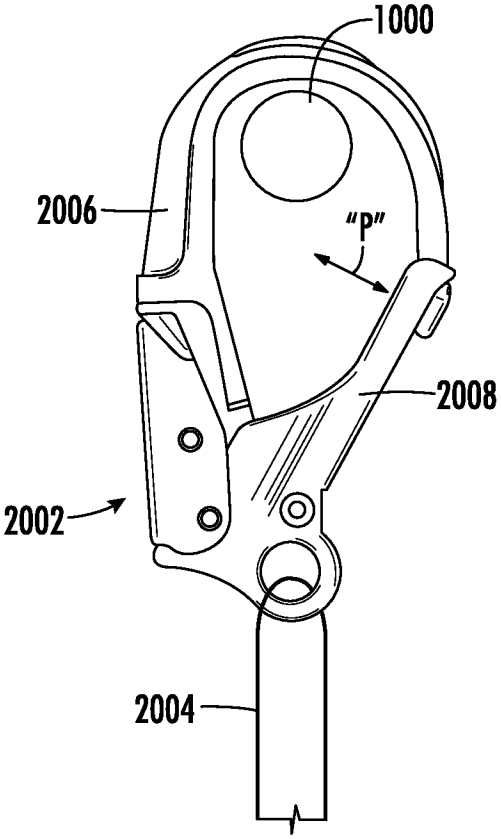
FIG. 17 is a view of a snap hook of the support assembly engaging the reinforcement member within the main module of the anchor apparatus.
Figure 16:
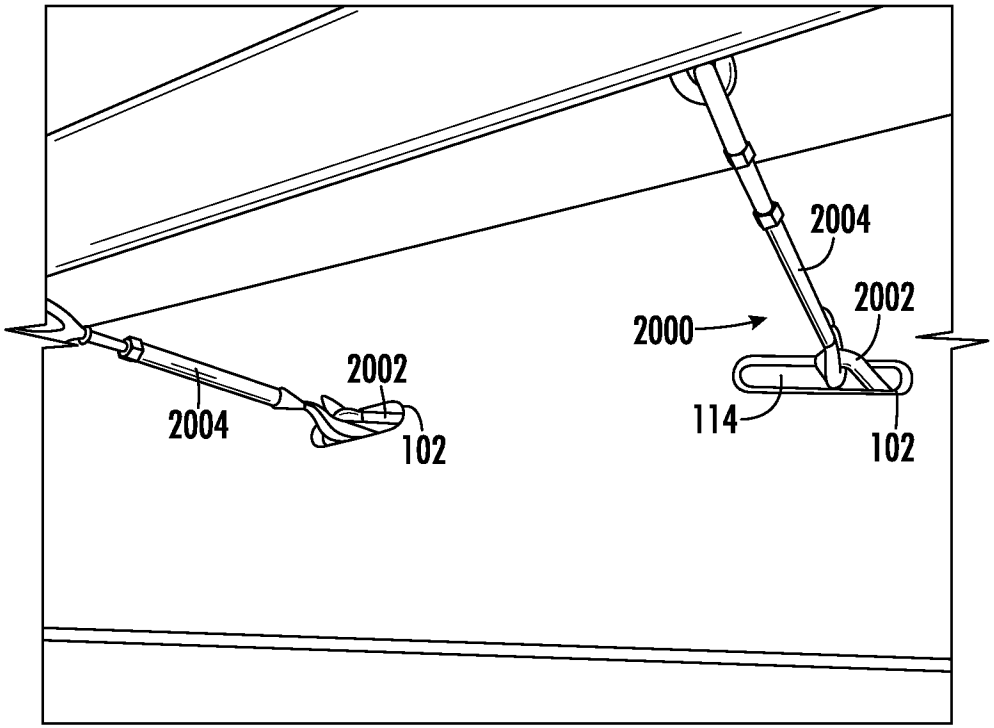
FIG. 16 is a view of the use of the anchor apparatus in securing a support assembly at a construction site.
Figure 20:
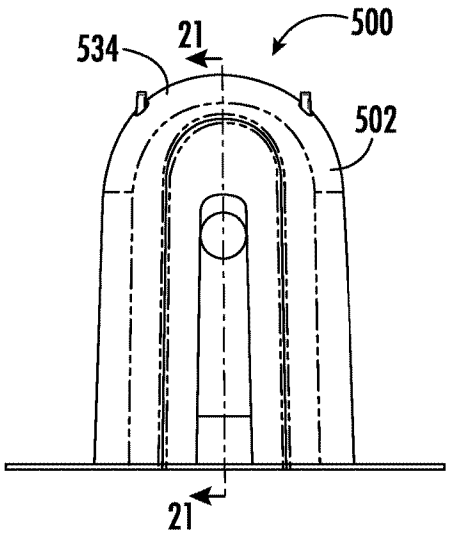
FIG. 20 is a side elevation view of the anchor apparatus of FIG. 18.
Figure 21:
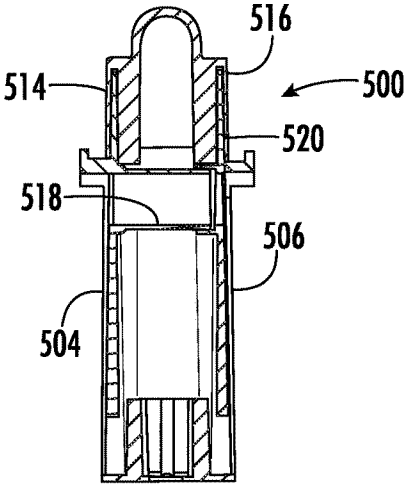
FIG. 21 is a cross-sectional view of the anchor apparatus taken along the lines 21-21 of FIG. 20.
Figure 19:
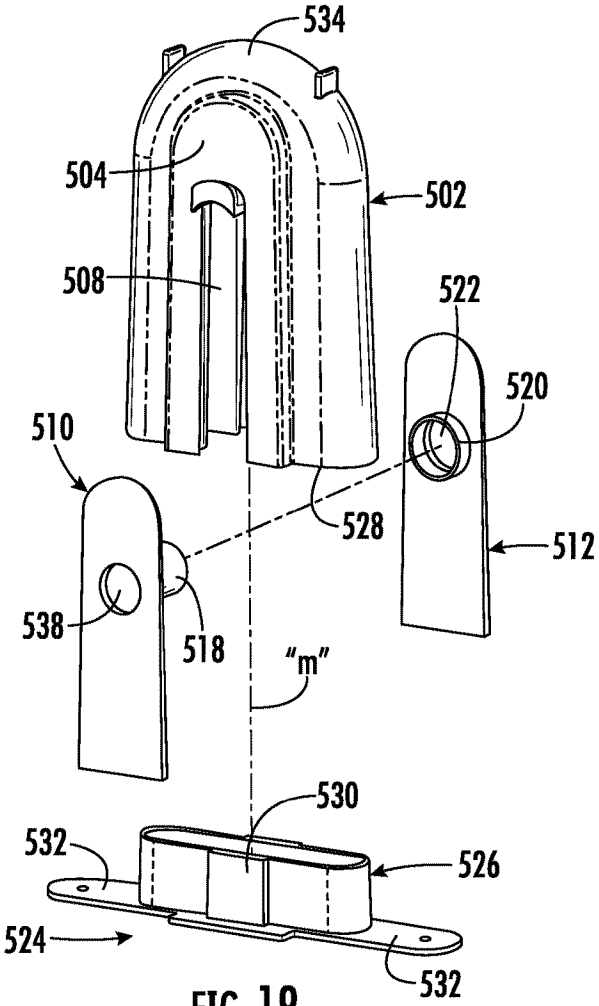
FIG. 19 is an exploded perspective view of the anchor apparatus of FIG. 18.
Figure 18:
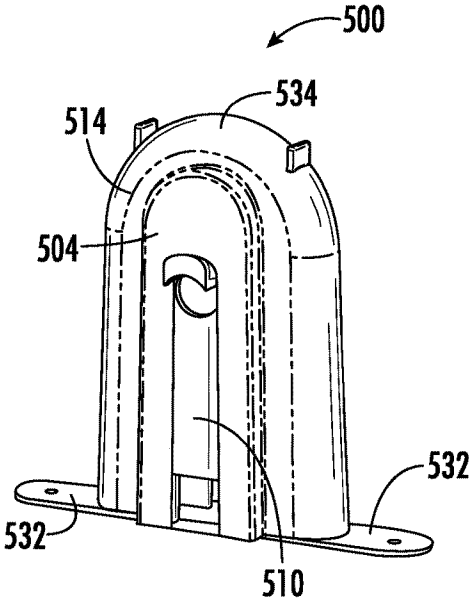
FIG. 18 is a perspective view of an alternate embodiment of the anchor apparatus.

Referring now FIG. 16, a support assembly 2000 including a coupling member such as a snap hook 2002 and a support bar or strap 2004 is secured about the rebar 1000 (shown in phantom), actually, about the first tubular segment 152 of the first movable support 106 which receives the reinforcement member 1000. In general, the snap hook 2002 is introduced within the open end 112 of the main module 102 and into the internal chamber 118 (with the end cap 104 removed). The snap hook 2002 is and snapped and locked about the first tubular segment 152 of the first movable support 106 and thus about the reinforcement member 1000 extending through the first tubular segment 152, the second tubular segment 158 of the second movable support 108 and through the main module 102. The support bar or strap 2004 may be secured to each snap hook 2002 either before or subsequent to placement of the snap hook 2002 about the rebar 1000. FIG. 17 illustrates the snap hook 2002 secured about the rebar 1000 (the first tubular segment 152 of the first movable support 106 is removed for illustrative purposes) within the main module 102. One suitable snap hook 2002 includes a main body 2006 and a lock 2008 pivotally mounted to the main body 2006 and adapted to pivot in the direction of directional arrow "p" between an open position (not shown) and a closed position as shown.

With a plurality of anchor apparatuses 100 and associated support mechanisms 2000 coupled thereto in select positions about the construction site, construction personnel may traverse the construction site, through engagement with the support assemblies 2000. Alternatively, the support assemblies 2000 may be used to support construction material, lines, ductwork, wires etc. It is to be appreciated that the movability of the first and second movable supports 106, 108 relative to the main module 102 may also accommodate shifting movement of construction material. For example, if the construction site is subjected to an event either natural or man-made, e.g., an earthquake or the like, which may potentially displace the construction material, the first and second movable supports 106, 108 will traverse their respective module mounts 120, 122 to accommodate any displacing movement, either lateral, vertical or horizontal, of the construction material thereby preserving the integrity of the unit.

Once it is determined the anchor apparatuses 100 are no longer needed, e.g., upon completion of a construction phase, the support assemblies 2000 may be removed from the rebar 1000 and their respective anchor apparatuses 100. In embodiments, the main module 102 of each anchor apparatus 100 may be filled with concrete to close the internal chambers 118. Thus, the anchor apparatuses 100 may be permanently embedded in the structural element, e.g., including the walls, columns, floors of the building, and do not require removal. In other embodiments, the main module 102 is left unfilled.

FIGS. 18-21 illustrate an alternate embodiment of the anchor apparatus of the present disclosure. The anchor apparatus 500 includes a main module 502 which is generally elongated defining a greater height and more narrow width than the module mount 102 of the anchor apparatus of FIGS. 1-14. The main module 502 includes first and second module mounts 504,506 each with an elongated opening 508 which is centrally located, e.g., generally aligned with the central longitudinal axis "m". First and second movable supports 510, 512 are received within correspondingly dimensioned module mounts 504, 506 on the first and second wall segments 514, 516, and are adapted to traverse the module mounts 504, 506 in first and second longitudinal directions with respect to the longitudinal axis "m". The first and second movable supports 510, 512 define first and second tubular segments 518, 520, respectively. The opening 522 of the second tubular segment 520 is cooperatively dimensioned to receive the first tubular segment 518 to couple the first and second movable supports 510, 512 in the same manner discussed hereinabove in connection with the apparatus of FIGS. 1-14.

The end cap 524 includes an outer wall 526 for reception within the lower end 528 of the main module 502. Cooperating ribs 530 on the end cap 524 may be received within correspondingly dimensioned grooves (not shown) adjacent the module mounts 504, 506 of the main module 502 to assist in aligning the end cap 524 with the main module 502 during insertion and assembly. The end cap 524 includes opposed flange segments 532 for securing the end cap 524 and the main module 502 to framing of the structure.

In this embodiment, the main module 502 is devoid of a spring to bias the first and second movable supports 510, 512 toward the top 534 of the main module 502 displaced from the end cap 524. The main module 502 also includes guides 536 adjacent the top of the elongated slots 508 to assist in aligning the reinforcement member 1000 with the opening 538 of the first tubular segment 518 of the first movable support 510 and the opening 522 of the second tubular segment 520 of the second movable support 512, and/or restrict movement of the reinforcement member 1000 within the elongated openings 508 of the first and second module mounts 504, 506. In other respects, the anchor apparatus 500 is utilized in a similar manner to the anchor apparatus 100 of FIGS. 1-14.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. A construction anchor apparatus, which comprises:

a main module including first and second wall segments and defining a central longitudinal axis;

a first movable support operatively coupled to the first wall segment of the main module, the first movable support defining an opening for reception of a reinforcement member;

a second movable support operatively coupled to the second wall segment of the main module, the second movable support defining an opening for reception of the reinforcement member; and the first and second movable supports being individual and distinct components configured for longitudinal movement relative to respective first and second wall segments of the main module, at least one of the first and second movable supports being biased in a first longitudinal direction with respect to the longitudinal axis.

2. The construction apparatus according to claim 1 wherein the first movable support comprises a first tube segment defining the opening for reception of the reinforcement member.

3. The construction apparatus according to claim 2 wherein the second movable support includes a second tube segment, the second tube segment defining the opening configured for reception of the first tube segment of the first movable support.

4. The construction apparatus according to claim 3 wherein the first and second movable supports are configured for movement in the first longitudinal direction and in a second longitudinal direction with respect to the longitudinal axis.

5. The construction apparatus according to claim 1 wherein the first and second wall segments of the main module include respective first and second module mounts.

6. The construction apparatus according to claim 5 wherein the first movable support is coupled to the first module mount and is configured for reciprocal longitudinal movement relative to the first module mount, and the second movable support is coupled to the second module mount and is configured for reciprocal longitudinal movement relative to the second module mount.

7. The construction apparatus according to claim 6 wherein the openings of the first and second movable supports are each configured to permit passage of the reinforcement member therethrough.

8. The construction apparatus according to claim 7 wherein each of the first and second module mounts includes an elongated opening for passage of the reinforcement member extending through the openings of the first and second movable supports.

9. The construction apparatus according to claim 7 wherein at least one of the first or second module mounts includes a guide depending outwardly therefrom with respect to the central longitudinal axis, the guide configured to facilitate alignment of the reinforcement member with the opening of the respective first or second movable supports.

10. The construction apparatus according to claim 1 including a biasing member mounted within the main module and operatively couplable to the at least one of the first and second movable supports to bias the at least one of the first and second movable supports in the first longitudinal direction.

11. The construction apparatus according to claim 1 wherein the first and second movable supports are configured for individual longitudinal movement relative to the respective first and second wall segments of the main module.

12. A construction apparatus, which comprises:

a main module including first and second wall segments and defining a central longitudinal axis;

a first movable support operatively coupled to the first wall segment of the main module, the first movable support having a first tube segment defining an opening therethrough;

a second movable support operatively coupled to the second wall segment of the main module, the second movable support defining an opening configured for reception of the first tube segment of the first movable support to couple the first and second movable supports; and each of the first and second movable supports configured for longitudinal movement relative to respective first and second wall segments of the main module;

wherein the second movable support includes a second tube segment, the second tube segment defining the opening for reception of the first tube segment of the first movable support;

wherein the first and second movable supports are configured for movement in first and second longitudinal directions with respect to the longitudinal axis; and wherein at least one of the first and second movable supports is biased in a first longitudinal direction with respect to the longitudinal axis.

13. The construction apparatus according to claim 12 including a resilient member mounted within the main module, the resilient member operatively engageable with the at least one of the first or second movable supports.

14. The construction apparatus according to claim 13 wherein the resilient member is a spring member positioned to engage the first tube segment of the first movable support.

15. The construction apparatus according to claim 14 including an end cap mountable to the main module, the end cap supporting the spring member.

16. The construction apparatus according to claim 15 wherein the end cap includes spring supports correspondingly dimensioned to at least partially accommodate the spring member to facilitate alignment with the first tube segment of the first support module.

17. A construction anchor apparatus, which comprises:

a main module including first and second wall segments and defining a central longitudinal axis, the first and second wall segments each defining respective first and second slotted openings;

a first movable support operatively coupled to the first wall segment of the main module, the first movable support having a first tube segment defining an opening therethrough for reception of a reinforcement member;

a second movable support operatively coupled to the second wall segment of the main module, the second movable support defining an opening configured for reception of the first tube segment of the first movable support to couple the first and second movable supports, the opening configured for reception of the reinforcement member;

each of the first and second movable supports configured for longitudinal movement relative to respective first and second wall segments of the main module to permit longitudinal traversing movement of the reinforcement member within the main module; and a spring member operatively couplable to one of the first and second movable supports to bias the first and second supports in a first longitudinal direction.

18. A method, comprising:

positioning an anchor apparatus at a predetermined location within a construction site;

securing a main module of the anchor apparatus at the predetermined location, the main module defining a central longitudinal axis;

coupling first and second individual and distinct movable supports to the main module, each of the first and second movable supports having openings therethrough;

biasing at least one of the first and second movable supports in a first longitudinal direction relative to the central longitudinal axis;

passing a reinforcement member through the openings in the first and second movable supports and through the main module; and permitting the first and second movable supports to move in at least one of the first longitudinal direction or in a second opposed longitudinal direction to permit corresponding movement of the reinforcement member relative to the main module.

19. A method, comprising:

positioning an anchor apparatus at a predetermined location within a construction site;

securing a main module of the anchor apparatus at the predetermined location, the main module defining a central longitudinal axis;

coupling first and second movable supports to the main module and to each other, each of the first and second movable supports having openings therethrough;

biasing at least one of the first and second movable supports in a first longitudinal direction relative to the central longitudinal axis;

passing a reinforcement member through the openings in the first and second movable supports and through the main module; and securing a support assembly to the reinforcement member.

20. The method according to claim 18 wherein coupling the first and second movable supports includes positioning a first tube segment of the first movable support within a second tube segment of the second movable support to couple the first and second movable supports to each other, the first and second tube segments defining the openings in the first and second movable supports.

* * * * *